US005199899A

United States Patent [19]

Ittah

[11] Patent Number: 5,199,899

[45] Date of Patent: Apr. 6, 1993

[54] BRANCH CONNECTOR FOR ELECTRICALLY CONNECTING TWO ELECTRICAL CONDUCTORS

[75] Inventor: Jean Ittah, Villeneuve la Garenne, France

[73] Assignee: Societe Labinal, Montigny Le Bretonneux, France

[21] Appl. No.: 760,949

[22] Filed: Sep. 17, 1991

[30] Foreign Application Priority Data

Sep. 19, 1990 [FR] France ..... 90 11551

[51] Int. Cl.[5] ..... H01R 4/24

[52] U.S. Cl. ..... 439/403; 439/404; 439/687

[58] Field of Search ..... 439/395–407, 439/417, 418, 686–689, 695, 696, 697, 701, 709, 711, 712, 714, 718, 723, 724, 731

[56] References Cited

U.S. PATENT DOCUMENTS

| | | | |
|---|---|---|---|
| 3,708,779 | 1/1973 | Enright et al. | 439/403 |
| 3,945,705 | 3/1976 | Seim et al. | 439/403 |
| 4,127,312 | 11/1978 | Fleischhacker et al. | 439/403 |
| 4,679,880 | 7/1987 | Pitsch | 439/404 |
| 4,778,405 | 10/1988 | Sterken . | |

FOREIGN PATENT DOCUMENTS

| | | |
|---|---|---|
| 8603892 | 7/1986 | European Pat. Off. . |
| 2254395 | 5/1974 | Fed. Rep. of Germany . |
| 2058485 | 4/1981 | United Kingdom . |

*Primary Examiner*—David L. Pirlot
*Attorney, Agent, or Firm*—Sandler Greenblum & Bernstein

[57] ABSTRACT

Device for electrically connecting two conductors is provided with a first U-shaped electrical connection component with a base part and two sides, each side incorporating a slot widening at its part opening onto its free end. One of the sides comprising, close to the base part, a connecting band extending substantially perpendicularly to the edge of the side and integral with one of the sides of a second U-shaped electrical connection component with a base part and a second side, the sides of the second connection component incorporating slots widening at their part opening onto their free edge, the connecting band being bent so that the two components are substantially perpendicular to each other and the free edges of the sides of one of the components extending in a direction opposite to that in which the free edges of the sides of the other component extend.

5 Claims, 6 Drawing Sheets

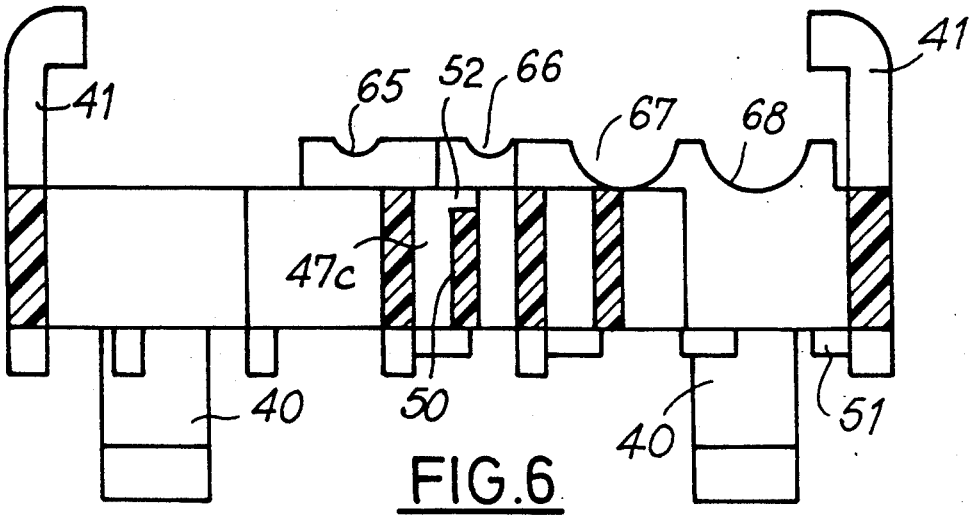
FIG.6
FIG.5
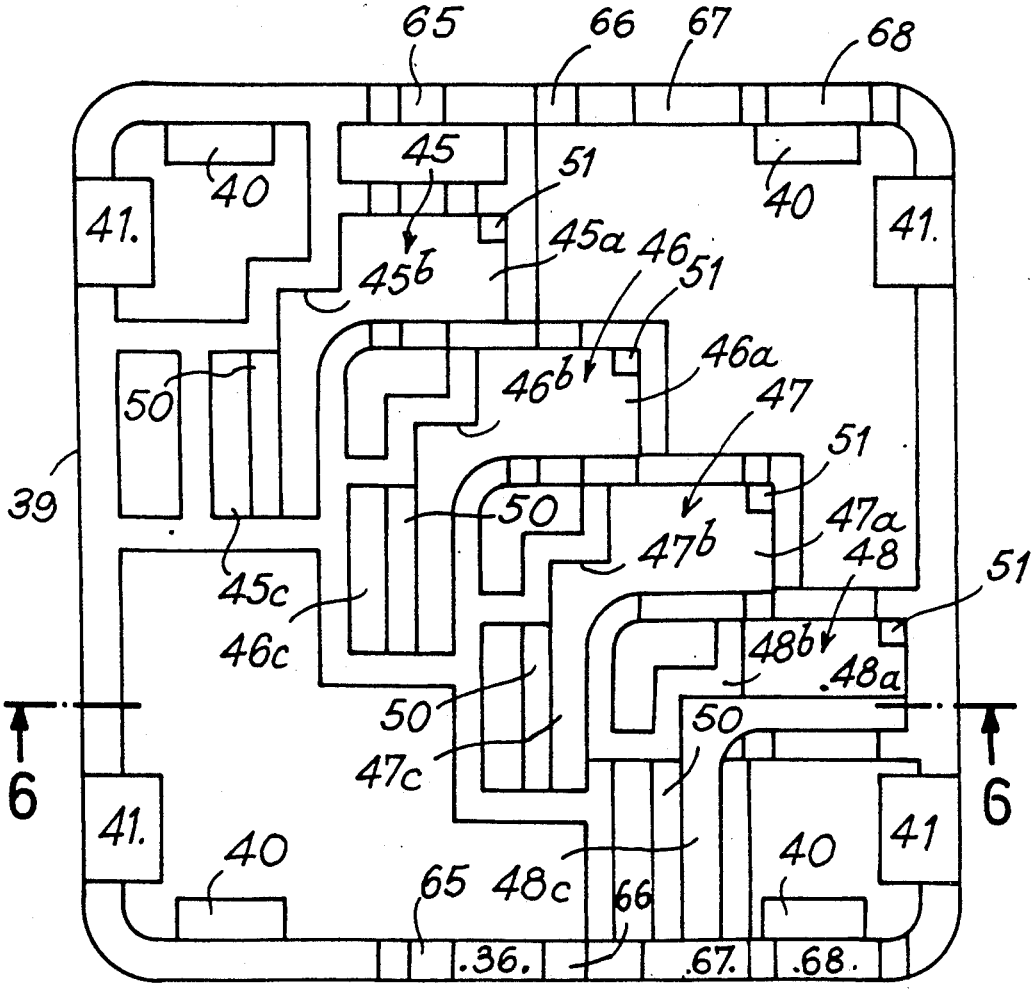

BRANCH CONNECTOR FOR ELECTRICALLY CONNECTING TWO ELECTRICAL CONDUCTORS

BACKGROUND OF THE INVENTION

The invention concerns an electrical connecting device for electrically connecting two conductors extending in perpendicular directions.

SUMMARY OF THE INVENTION

It is an object of the present invention to provide a connecting device of the type comprising a first electrical connection component with two sides, each including a slot which widens at its part opening onto its free end, and a second electrical connection component with two sides, each including a slot widening at its part opening onto its free edge, with the slots of the first electrical connection component facing a direction opposite to that of the slots of the second electrical connection component. In the connecting device the first electrical connection component is U-shaped with a base part connecting the two sides, and the second electrical connection component is U-shaped with a base part connecting the two sides. Additionally, one of the sides of the first electrical connection component comprises, close to its base part, a connecting band extending substantially perpendicularly to the edge of the side and integral with one of the sides of the second electrical connection component close to the base part of the second component, with the connecting band being bent so that the slots of the first component are aligned in a direction substantially perpendicular to the alignment of the slots of the second component.

Preferably, the longitudinal edges of the sides of at least one of the components include a notch. Such an arrangement enables the connecting device to be fitted easily into a case.

To facilitate the insertion of the conductors into the slots, when the conductors are isolated, the edges of the slots are cutting edges close to the free ends of the sides.

It is also an object of the present invention to provide a branch connector using the above-discussed connecting device. In particular, the branch connector comprises two half-shells, an intermediate element designed to be inserted between the two half-shells, and means for assembling the half-shells with the intermediate element. The intermediate element includes a series of channels opening on its two faces, and each channel being designed to receive a connecting device. Stops are provided to immobilize the connecting devices in the channels in such a way that the ends of the sides of the first component protrude at one of the ends of the channels and the ends of the sides of the second component protrude at the other end of the channels, and the bottoms of the half-shells are spaced to be located at the same depth as the length of the sides of the first and second components.

According to a particular constructional characteristic, each channel has a stop, on the side of one face of the intermediate element, designed to cooperate with the outer surface of the base part of the first component and on the side of the other face a partition designed to be inserted between the sides of the component and to cooperate with the inner surface of its base part.

In order to construct as compact a connector as possible, the intermediate element is of a generally square shape, with the part of the channels designed to cooperate with the ridge of the bend in the connecting band being diagonally aligned.

The intermediate element comprises on each of its side hooks, while the half-shells include sloping parts ending in right-angle indentations designed to cooperate with the hooks.

Additionally, the hooks on the two faces are located on two opposite sides, the hooks on one face being located on two sides on which the hooks of the other face are not located. Through this arrangement, the two half-shells can be identical and mounted indifferently on either face of the intermediate element.

In other words, it is an object of the present invention to provide a device for electrically connecting two conductors comprising a first U-shaped electrical connection component having a base portion from which extend two sides, each of the two sides including longitudinal edges and a free end having a slot widening at an area where the slot opens at its free end; a second U-shaped electrical connection component having a base portion from which extend two sides, each of the two sides including longitudinal edges and a free end having a slot widening at an area where the slot opens to at its free end; and a connecting band extending substantially perpendicularly to an edge of one of the two sides of the first electrical connection component comprising, close to its base portion, and connected with one of the two sides of the second electrical connection component close to its base portion, the connecting band being bent so that the slots of the first component are aligned in a direction substantially perpendicular to the alignment of the slots of the second component.

As discussed above, the longitudinal edges of the sides of at least one of the first component and the second component can include a notch, and the edges of the slots can comprise cutting edges close to the free ends.

It is also an object of the present invention to provide a branch connector comprising at least one connecting device as described above, two half-shells, an intermediate element designed to be inserted between the two half-shells, and means for assembling the two half-shells with the intermediate element. The intermediate element includes an upper face and a lower face, and comprises a series of channels with each channel constructed and arranged to receive a connecting device, each channel in the series of channels includes an upper end opening onto the upper face and a lower end opening onto the lower face. Stops are positioned to immobilize a connecting device in each channel so that the free ends of the sides of the first component protrude from one of the upper end or lower end of its corresponding channel, and the free ends of the sides of the second component protrude from the other end of its corresponding channel. Each of the half-shells has a bottom at a depth, when in position on the intermediate element, wherein corresponding free ends of the first component and the second component bear against a corresponding bottom.

Additionally, as discussed above, each channel can include a stop, on the side of one face of the intermediate element, designed to cooperate with the outer surface of the base part of the first component and on the side of the other face a partition designed to be inserted between sides of the second component and to cooperate with the inner surface of its base part. The intermediate element can be of a generally square shape, and a part of each channel can be constructed and arranged to cooperate with the bent portion of the connecting band and being diagonally aligned. Also, the intermediate element can comprise hooks on each of its sides, and the half-shells can include sloping parts ending in right-angled indentations designed to cooperate with the hooks. The intermediate element can comprise two sets of opposing sides, with the hooks of one of the two sets of opposing sides being located on the upper face of the intermediate element, and the hooks on the other of the two sets of opposing sides being located on the lower face of the intermediate element.

It is also an object of the present invention to provide a device for electrically connecting two conductors comprising a strip of electrically conductive metal, with the strip comprising a first extended leg portion comprising two ends, each of the two ends extending to a free edge and having a slot which opens onto the free edge; a second extended leg portion comprising two ends, each of the two ends extending to a free edge and having a slot which opens onto the free edge; and a band having two edges, the band connecting the first extended leg portion to the second extended leg portion, one of the two edges being positioned at a level with a bottom of a slot in one of the two ends of the first extended leg portion and being positioned offset from a first central location on the second extended leg portion between the first central location and the bottom of a slot in one of the two ends of the first extended leg portion, and the other edge of the two edges being positioned at a level with a bottom of a slot in one of the two ends of the second extended leg portion and being positioned offset from a second central location on the first extended leg portion between the second central location and the bottom of a slot in one of the two ends of the second extended leg portion.

Each of the slots can widen to its corresponding free edge. Additionally, the first extended leg portion and the second extended leg portion can have longitudinal side edges, and at least one of the longitudinal side edges of the first extended leg portion and the second extended leg portion can include at least one notch.

The edges of the slots can be cutting edges close to the free edges. Moreover, the first extended leg portion can be bendable to form a first U-shaped electrical connection component having a base portion from which extend two sides, each of the two sides including longitudinal edges and a free end having a slot widening at an area where the slot opens at its free end; the second extended leg portion can be bendable to form a second U-shaped electrical connection component having a base portion from which extend two sides, each of the two sides including longitudinal edges and a free end having a slot widening at an area where the slot opens to at its free end; and the connecting band can be bendable to extend substantially perpendicularly to an edge of one of the two sides of the first electrical connection component comprising, close to its base portion, and connected with one of the two sides of the second electrical connection component close to its base portion, with the connecting band being bent so that the slots of the first component are aligned in a direction substantially perpendicular to the alignment of the slots of the second component.

It is a further object of the present invention to provide a branch connector comprising two half-shells; an intermediate element designed to be inserted between the two half-shells; means for assembling the two half-shells with the intermediate element, with the intermediate element having an upper face and a lower face, and comprising a series of channels with each channel constructed and arranged to receive a connecting device, each channel in the series of channels having an upper end opening onto the upper face and a lower end opening onto the lower face. Stops are positioned to immobilize a connecting device in each channel so that the free ends of the sides of a first component of the connecting device protrude from one of the upper end or lower end of one of the channel, and free ends of sides of a second component of the connecting device protrude from the other end of the channel; and each of the half-shells has a bottom at a depth, when in position on the intermediate element, Wherein corresponding free ends of the first component and the second component are capable of bearing against a corresponding bottom.

This branch connector can include the various elements as previously described above.

BRIEF DESCRIPTION OF THE DRAWINGS

The invention will now be described with greater detail referring to a particular embodiment given by way of example only, and with reference to the appended drawings, in which:

FIG. 5 is a plan view of the intermediate element.

FIG. 6 is a sectional view along the line 6—6 in FIG. 5.

DESCRIPTION OF THE PREFERRED EMBODIMENTS

Figure 3:
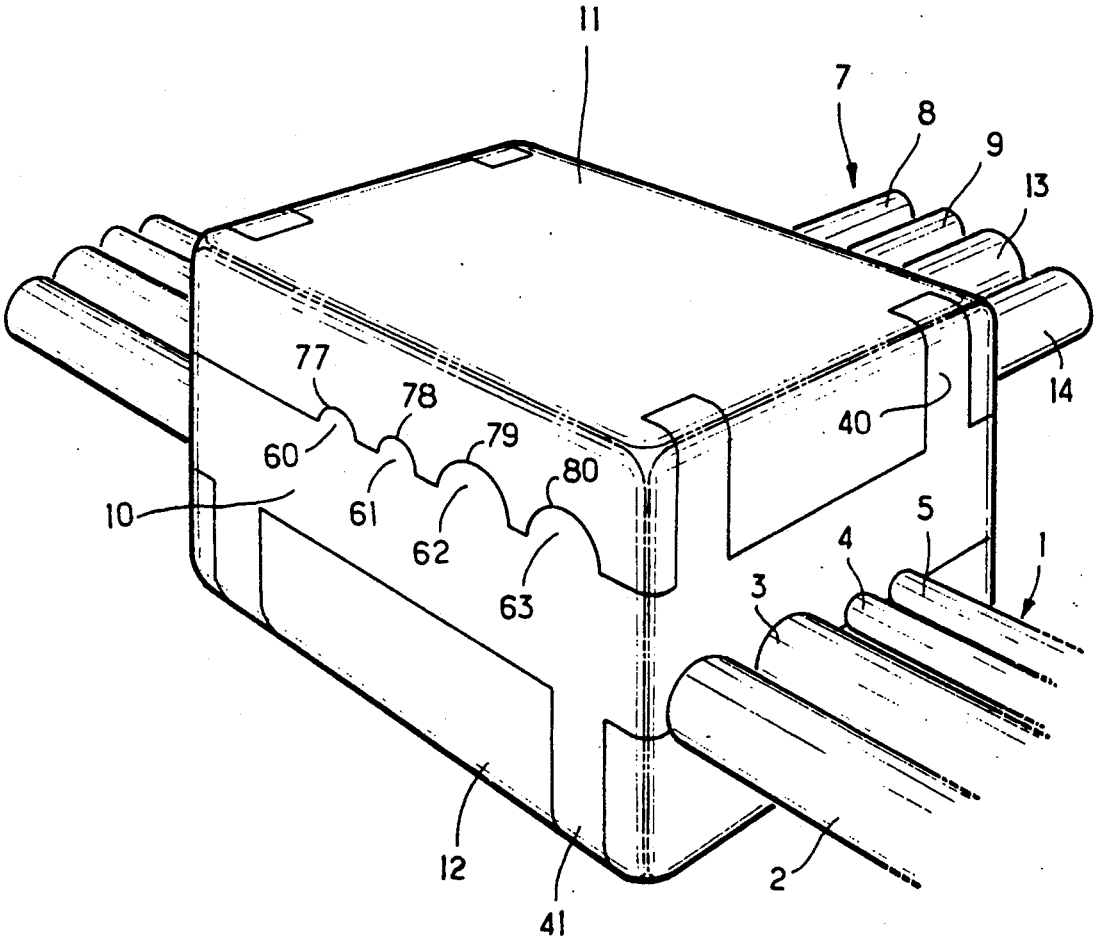
FIG. 3 is a perspective view of the branch connector in accordance with the invention.

The branch connector, in accordance with the invention, and as illustrated in FIG. 3, is designed to be used with a ribbon cable 1 comprising four parallel conductors, with the conductors 2 and 3 having a larger section and the conductors 4 and 5 having a smaller section.

The ribbon cable 1 is connected to the power source and its conductors are the current carrying conductors.

The connector is designed to be used for the branch connection of the identical ribbon cable 7 comprising four conductors 8, 9, 13 and 14, with conductors 8 and 9 having a smaller section and the conductors 13 and 14 having a greater section.

The branch connector is designed to be fitted onto the ribbon cable 1, and allows the conductors of the ribbon cable 7 to be electrically connected to those of the ribbon cable 1, with the ribbon cable 7 extending in a direction perpendicular to that of the ribbon cable 1.

The branch connector comprises an intermediate element 10 and two half-shells 11 and 12 which are attached to the intermediate element.

Figure 1:
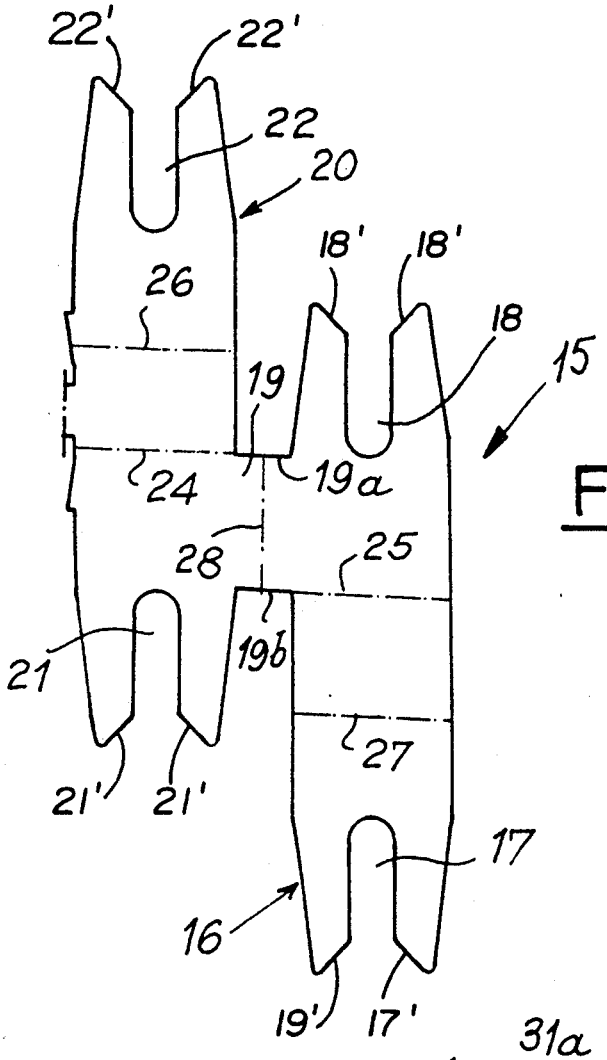
FIG. 1 a plan view showing an electrical connecting device.
Figure 2:
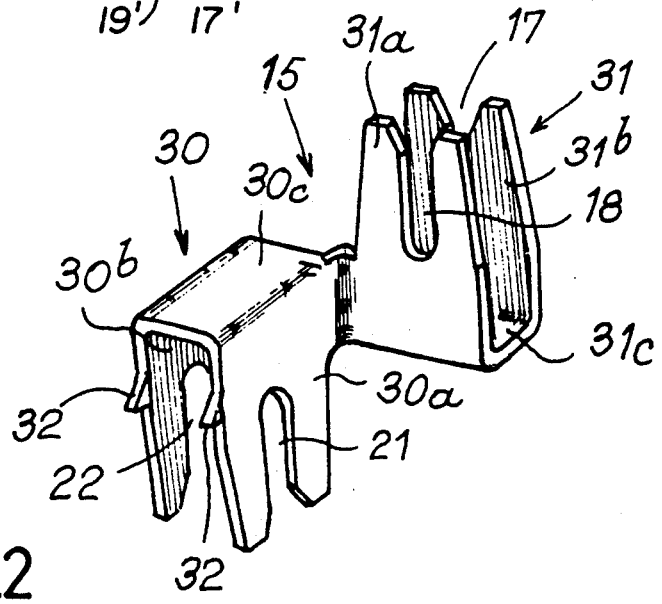
FIG. 2 is a perspective view of the device obtained after bending.

The intermediate element 10 is designed to receive four connecting devices 15 (see FIGS. 1 and 2). Each connecting device 15 is cut from a strip of metal, which is a good conductor of electricity, and includes a first extended leg 16. One end of the extended leg includes a slot 17 having free edges 17' which widen out, while the other end comprises a slot 18 with widened out free edges 18'. Close to the end incorporating the slot 18, there extends perpendicularly to the leg 16 a connecting band 19 connecting the leg 16 to a second leg 20.

At its ends, the second leg 20 incorporates slots 21 and 22 corresponding to slots 17 and 18, and including widened out free edges 21' and 22', respectively.

One of the edges 19*a* of the band 19 is located level with the bottom of the slot 18, while the other edge 19*b* is located level with the bottom of the slot 21.

In the axis of the edge 19*a* along a line 24, the leg 20 is bent at right angles on the side of one face of the band 19, while the leg 16 is bent on the side of the other face of the band 19 along a line 25 in the extension of the edge 19*b*.

On the leg 16, there is a second bending line 27 along which the corresponding end of the leg 16 is bent at right angles, while on the leg 20 there is a second bending line 26 along which the free end of the leg 20 is bent at right angles. In this way there are formed two insulation displacement electrical connection components 30 and 31 disposed top to bottom, with the connecting band 19 being bent at right angles along a median line 28 such that a plane passing through the slots 17, 18 is aligned in a direction perpendicular to a plane passing through slots 21 and 22.

The connection component 30 is U-shaped with a side 30*a* incorporating the slot 21, a base part 30*c* formed by the part located between the lines 24 and 26, and a side 30*b* incorporating the slot 22.

The connection component 31 is also U-shaped with a base part 31*c* formed by the part located between the two lines 25 and 27, and two sides 31*a* and 31*b*, the first side incorporating slot 18 and the second side incorporating slot 17.

Each of the free edges of the sides 30A and 30B incorporates a notch 32.

Figure 4:
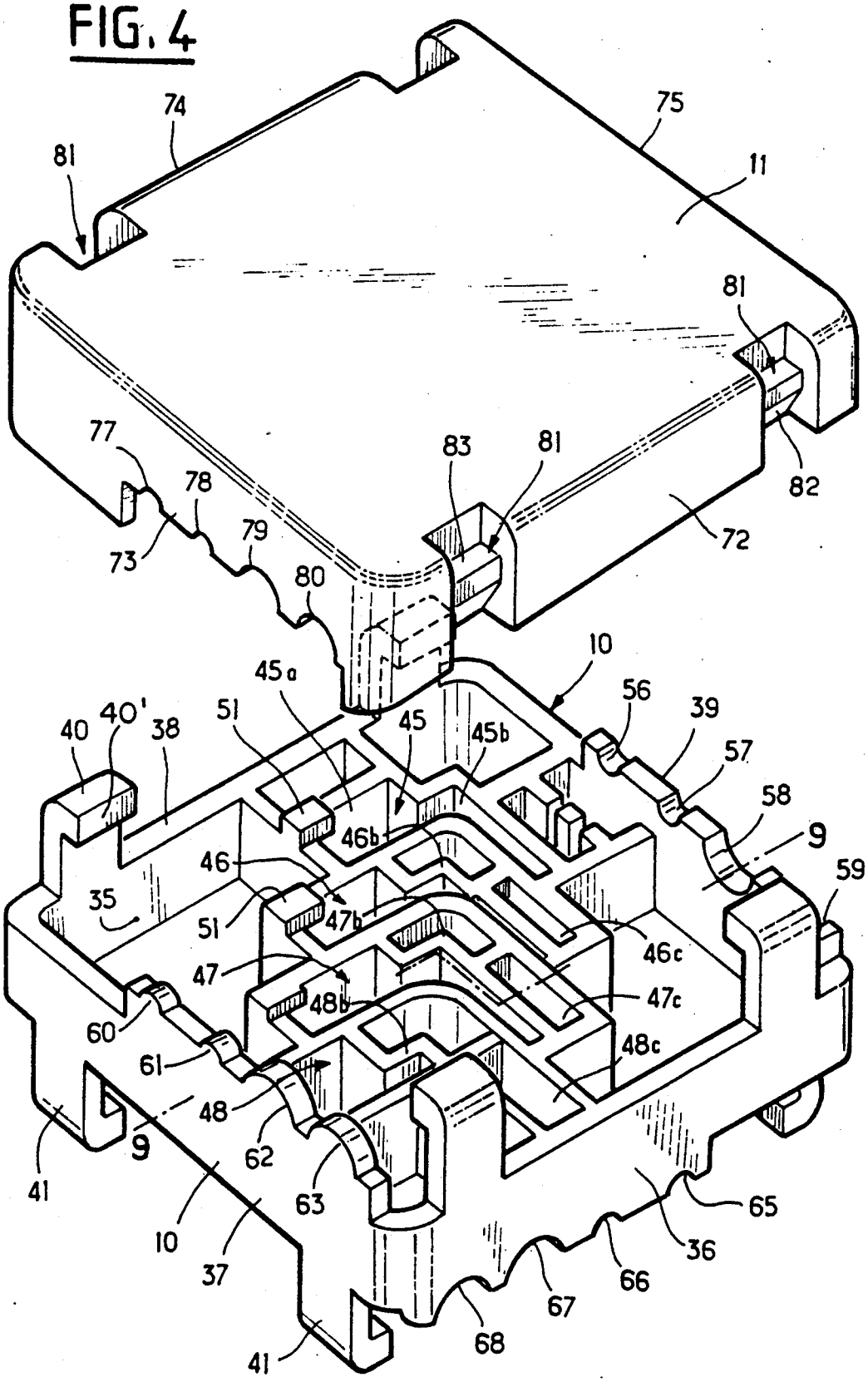
FIG. 4 is perspective view of the intermediate element.

The intermediate element 10 (see FIGS. 4, 5 and 6) is formed from a generally square body 35 with four side walls 36, 37, 38 and 39.

One edge of each of the walls 36 and 38 incorporates two tabs 40 ending in a shoulder 40' to form a hook, and each of the walls 37 and 39 incorporates two tabs 41 ending in a shoulder 41' to form a hook.

Inside the body 35, there is a series of walls forming four channels 45, 46, 47 and 48. The channel 45 opens onto one of the two faces of the body and comprises a part 45*a* corresponding to the component 30, an angular part 45*b* having a shape which corresponds to the shape of the portion of the base part 30*c* adjacent to the band 19, to the band 19 and to the edge of the corresponding base part 31*c*, and a housing 45*c* having dimensions which correspond to the component 31 and which incorporates a partition 50.

The other channels 46, 47 and 48 are identical to the channel 45 and include parts 46*a*, 47*a*, 48*a*, angular parts 46*b*, 47*b* and 48*b*, and housings 46*c*, 47*c* and 48*c* which each include a partition 50.

On one face of the element 10 (see FIG. 4), the channels 45, 46, 47 and 48 are provided with a stop 51, while on the other surface the partitions 50 have an indentation 52 corresponding to the thickness of the base part 31*c* of the component 31.

Figure 9:
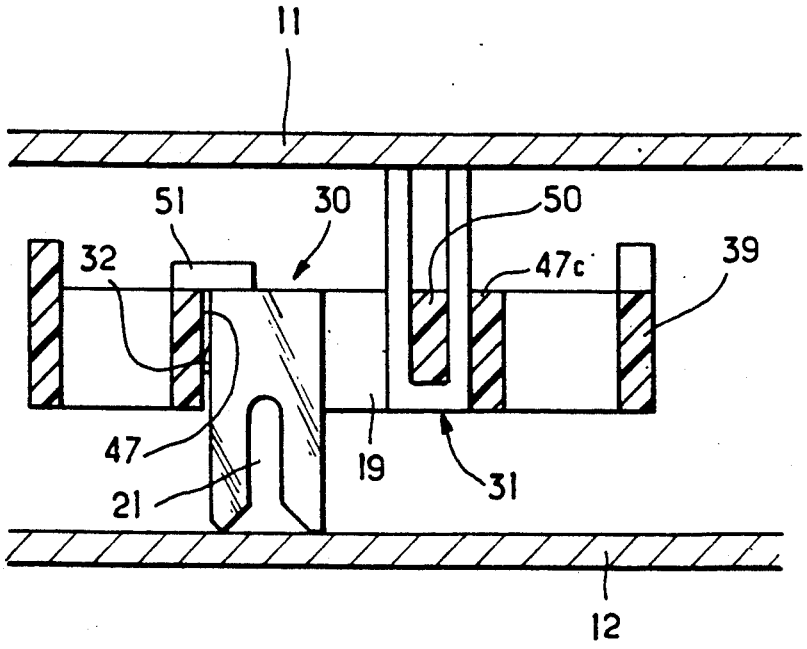
FIG. 9 is a sectional view along 4, with the connecting device assumed to be fitted.

FIG. 9 is a sectional view of a connecting device 15 in position in the channel 47. This device is positioned in such a way that the base part 30*c* of the component 30 is positioned on the side opposite the stop 51, while the free ends of the sides 31A and 31B engage in the housing 47C on either side of the partition 50. As the device 15 is being placed in position, the notches 32 are inserted in the corresponding wall of the channel 47. The device 15 rests against the edge of the partition 50, and bears against the stop 51, and is therefore held by the notches 32, and cannot be withdrawn.

It will be noticed that the angular parts 45*b*, 46*b*, 47*b* and 48*b* are aligned along a diagonal of the intermediate element 10, thereby reducing the dimensions of the connector.

The wall 39 on the side of the tabs 40 incorporates notches 56, 57, 58 and 59 corresponding to the conductors 8, 9, 13 and 14 of the ribbon cable 7, while along the corresponding edge of the wall 37 there are corresponding ridges 60, 61, 62 and 63.

In this embodiment, the ribbon cable 7 has one end housed in the branch connector but, it is possible for said connector to be fitted at an intermediate point along a ribbon cable 7. In this case, the intermediate element 10 incorporates, instead of the ridges 60, 61, 62 and 63, notches corresponding to the notches 56, 57, 58 and 59.

The edges of the walls 36 and 38 incorporate notches 65, 66, 67 and 68 corresponding to the conductors 5, 4, 3 and 2 of the ribbon cable 1.

Figure 7:
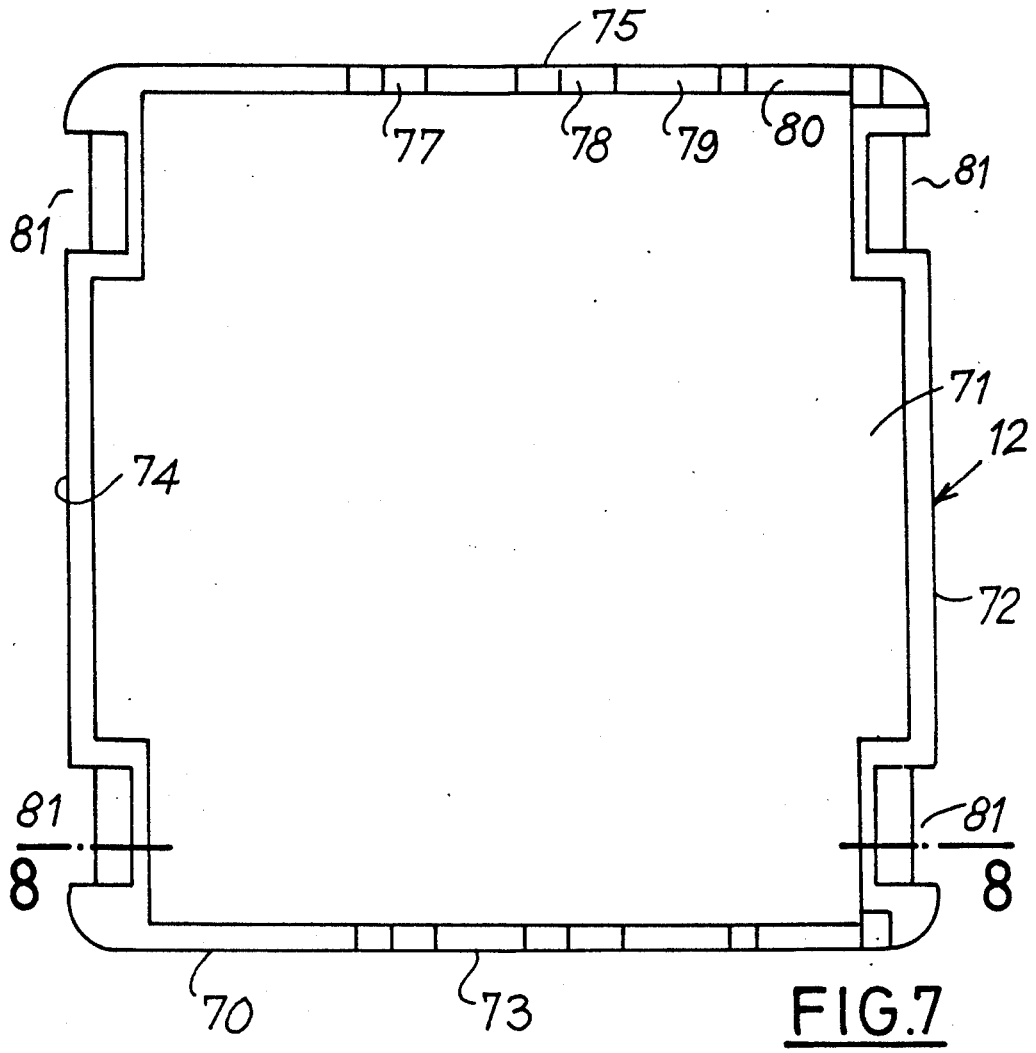
FIG. 7 is a plan view from below one of the half-shells.
Figure 8:
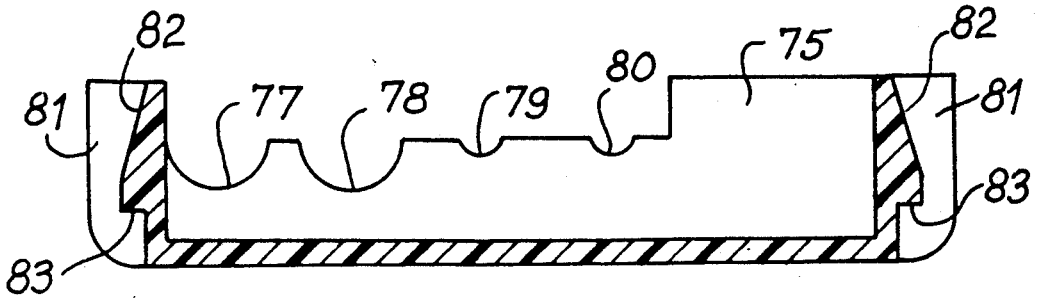
FIG. 8 is a sectional view along the line 8—8 in FIG. 7.

The half-shell 12 (see FIGS. 7 and 8) is formed from a body 70 in the form of a tray having a bottom 71 bordered by four side walls 72, 73, 74 and 75. The walls 73 and 75 comprise along their edge, notches 77, 78, 79 and 80 corresponding to the notches 68, 67, 66 and 65, while the side walls 72 and 74 incorporate two slots 81 in which extend sloping parts 82 ending in right-angled indentations 83.

The half-shell 12 is positioned facing the corresponding face of the intermediate element 10 so that the tabs 41 are lodged in the slots 81 and through slight elastic deformation, these latch over the ends of the sloping parts 83.

The half-shell 11 is identical to the half-shell 12, but is positioned facing the intermediate element 10 the other way round and offset 90° so that the notches 77, 78, 79 and 80 of the wall 75 coincide with the notches 56, 57, 58 and 59 of the wall 39, while the notches 77 through 80 of the wall 73 cooperate with the ridges 60 through 63 of the wall 37.

The ribbon cable 1 is positioned so that the conductor 2 is inserted in the slots 21 and 22 of the device 15 housed in the channel 48, the conductor 3 being inserted in the slots 21 and 22 of the device 15 placed in the channel 47 and the conductors 4 and 5 in the slots 21 and 22 of the devices 15 inserted in the channels 46 and 45, respectively. The half-shell 12 is then placed in position. When the conductors are placed in position, the edges of the slots cut the insulation, with the strands of the conductor cooperating with the slots to provide the electrical connection. The length of the sides 30*a* and 30*b* and the depth of the half-shell 12 are such that, when the half-shell is placed in position, the ends of the sides bear against the bottom, in such a way that the conductors cannot accidentally become detached from the slots 21 and 22.

The branch ribbon cable 7 is placed in position on the intermediate element 10, the end of which rests against the ridges 60, 61, 62 and 63 while the conductors 8, 9, 13 and 14 are lodged in the slots 17 and 18 of the components 31, with the edges of the slots cutting the insulation so that the strands of the conductors, bearing against the edges of this slot, provide the electrical connection. Of course, the electrical conductor 14 will operate with the component 31 placed in the housing 48C so that the conductors of the same section are electrically connected. The half-shell 11, once placed in position, will lock the conductors in the slots 17, 18.

This application is related to French Application No. 90.11 551, filed Sep. 19, 1990, whose priority is claimed, the disclosure and drawings of which are incorporated by reference thereto in their entirety.

Of course, the invention is not limited to the embodiment which has just been described and illustrated. Many detail modifications can be made to it without thereby departing from the scope of the invention.

What is claimed:

1. Branch connector comprising:

two half-shells;

an intermediate element designed to be inserted between said two half-shells;

means for assembling said two half-shells with the intermediate element;

said intermediate element having an upper face and a lower face, and comprising a series of channels with each channel constructed and arranged to receive a connecting device, each channel in said series of channels having an upper end opening onto said upper face and a lower end opening onto said lower face;

stops positioned to immobilize a connecting device in each channel so that free ends of sides of a first component of the connecting device protrude from one of said upper end or lower end of one of the channels, and free ends of sides of a second component of the connecting device protrude from the other end of the channel;

each of said half-shells has a bottom at a depth, when in position on said intermediate element, wherein corresponding free ends of the first component and the second component are capable of bearing against a corresponding bottom; and each channel has a stop, on a side of one face of said upper face and said lower face of the intermediate element, capable of cooperating with an outer surface of a base part of the first component, and, on a side of another face of said upper face and said lower face of the intermediate element, a partition designed to be inserted between sides of the second component and to cooperate with an inner surface of a base part of the second component.

2. The branch connector according to claim 1, wherein said intermediate element is of a substantially square shape, and a part of each channel is constructed and arranged to cooperate with a bent portion of a connecting band of the connecting element, with said part of each channel being diagonally aligned with respect to a line substantially passing through opposing corners of said substantially square shape intermediate element.

3. The branch connector according to claim 1, wherein said intermediate element includes sides and comprises hooks on each of said sides, and the half-shells include sloping parts ending in right-angled indentations designed to cooperate with said hooks.

4. The branch connector according to claim 3, wherein said intermediate element comprises two sets of opposing sides, the hooks of one of said two sets of opposing sides being located on said upper face of said intermediate element, and the hooks on the other of said two sets of opposing sides being located on said lower face of said intermediate element.

5. Branch connector comprising:

two half-shells;

an intermediate element designed to be inserted between said two half-shells;

means for assembling said two half-shells with the intermediate element;

said intermediate element having an upper face and a lower face, and comprising a series of channels with each channel constructed and arranged to receive a connecting device, each channel in said series of channels having an upper end opening onto said upper face and a lower end opening onto said lower face;

stops positioned to immobilize a connecting device in each channel so that free ends of sides of a first component of the connecting device protrude from one of said upper end or lower end of one of the channels, and free ends of sides of a second component of the connecting device protrude from the other end of the channel;

each of said half-shells has a bottom at a depth, when in position on said intermediate element, wherein corresponding free ends of the first component and the second component are capable of bearing against a corresponding bottom; and said intermediate element comprises two sets of opposing sides with hooks on each side of said two sets of opposing sides and the half-shells including sloping parts ending in right-angled indentations designed to cooperate with said hooks, and the hooks of one of said two sets of opposing sides being located on said upper face of said intermediate element, and the hooks on the other of said two sets of opposing sides being located on said lower face of said intermediate element.

* * * * *